US011462069B2

(12) United States Patent
Vilhelmsen

(10) Patent No.: US 11,462,069 B2
(45) Date of Patent: Oct. 4, 2022

(54) TRACKING TRANSPORTATION FOR HANDS-FREE GATE

(71) Applicant: Cubic Corporation, San Diego, CA (US)

(72) Inventor: Tom Vilhelmsen, Holbaek (DK)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 17/159,966

(22) Filed: Jan. 27, 2021

(65) Prior Publication Data

US 2021/0248853 A1 Aug. 12, 2021

Related U.S. Application Data

(60) Provisional application No. 62/966,113, filed on Jan. 27, 2020.

(51) Int. Cl.

| | |
|---|---|
| ***G07C 9/28*** | (2020.01) |
| ***G07C 9/25*** | (2020.01) |
| ***G07C 9/27*** | (2020.01) |
| ***G07C 9/29*** | (2020.01) |

(52) U.S. Cl.

CPC ..... *G07C 9/28* (2020.01); *G07C 9/253* (2020.01); *G07C 9/27* (2020.01); *G07C 9/29* (2020.01)

(58) Field of Classification Search

CPC ... G07C 9/38; G07C 9/32; G07C 9/20; G07C 9/10; G07C 9/29; G07C 9/253; G07C 9/28; G07C 9/27–29; G07B 15/04

See application file for complete search history.

(56) References Cited

U.S. PATENT DOCUMENTS

| | | | | |
|---|---|---|---|---|
| 4,944,036 | A | 7/1990 | Hyatt | |
| 8,181,867 | B1 * | 5/2012 | Bierbaum | G06Q 20/405 235/384 |
| 8,923,186 | B1 | 12/2014 | DaCosta | |
| 9,363,651 | B1 | 6/2016 | DaCosta | |
| 10,304,275 | B2 * | 5/2019 | Dyne | G07B 15/04 |
| 11,336,511 | B2 * | 5/2022 | Johnson | H04L 67/141 |

(Continued)

OTHER PUBLICATIONS

Website: "Mesh Dymanics", https://www.meshdynamics.com/mesh-network-presentations.html#ListOfPatentsNotPending, retrieved Jan. 11, 2021.

*Primary Examiner* — Daniel I Walsh

(74) *Attorney, Agent, or Firm* — Kilpatrick Townsend & Stockton LLP

(57) ABSTRACT

A transit system including an access control point, a positioning system, a tracking system, and a server. The access control point provides a passage to a transit user for taking a trip through the transit system. The server receives a first location and visual cues of the transit user. The first location is determined using the positioning system and a mobile device. Candidate locations and visual cues of other transit users are obtained from the tracking system. The server correlates the first location to a candidate location and compares the visual cues of the transit user with the other transit users. A correlated location is determined and the first location and the visual cues of the transit user are verified. The server verifies terms of a transit pass of the transit user. Based on the verification, usage of the transit pass is allowed for passing through the access control point.

20 Claims, 11 Drawing Sheets

(56) References Cited

U.S. PATENT DOCUMENTS

2006/0243796 A1* 11/2006 Macklin ..... G06Q 10/02 235/382
2008/0195257 A1* 8/2008 Rauch ..... B61B 1/02 701/1
2008/0198228 A1* 8/2008 Rizk ..... G07C 5/0891 348/148
2011/0001606 A1* 1/2011 Charych ..... G07C 9/28 235/382
2015/0123794 A1* 5/2015 Hamalainen ..... G01S 19/42 340/539.13
2016/0042631 A1* 2/2016 Ho ..... G06Q 10/10 340/5.32
2016/0307380 A1* 10/2016 Ho ..... G07C 9/00309
2016/0343187 A1* 11/2016 Trani ..... G07C 9/253
2016/0371893 A1* 12/2016 Busch-Sorensen ..... G06Q 20/3278
2017/0061715 A1* 3/2017 Busch-Sorensen ..... G06K 7/10366
2017/0236113 A1* 8/2017 Chitalia ..... G06Q 20/385 705/44
2018/0076842 A1 3/2018 Rubens et al.
2018/0211188 A1* 7/2018 Bergdale ..... G07G 1/14
2019/0039634 A1* 2/2019 Tokumaru ..... B61L 25/025
2019/0122475 A1* 4/2019 Dyne ..... G07C 9/10
2019/0360812 A1* 11/2019 Kayhani ..... G07C 9/28
2020/0213818 A1 7/2020 Wilson et al.
2021/0022536 A1* 1/2021 Anderson ..... B64C 39/024
2021/0081698 A1* 3/2021 Lindeman ..... G01N 21/8851
2021/0117659 A1* 4/2021 Foroozan ..... G06K 9/00496
2021/0210053 A1* 7/2021 Ng ..... G06V 40/70
2021/0225091 A1* 7/2021 Packham ..... G01S 17/58
2021/0248853 A1* 8/2021 Vilhelmsen ..... G07C 9/28
2021/0272086 A1* 9/2021 Bui ..... G07G 1/0054
2021/0287468 A1* 9/2021 Vilhelmsen ..... G07C 9/10
2021/0304584 A1* 9/2021 Singh ..... G01S 5/16
2021/0321223 A1* 10/2021 Adachi ..... H04L 9/321
2021/0358237 A1* 11/2021 Miller ..... G07C 9/00571
2021/0375083 A1* 12/2021 Vilhelmsen ..... G06K 9/00771
2021/0383626 A1* 12/2021 Dominici ..... G07C 9/00817

* cited by examiner

TRACKING TRANSPORTATION FOR HANDS-FREE GATE

This application claims the benefit of and is a non-provisional of U.S. (Provisional) Application Ser. No. 62/966,113 filed on Jan. 27, 2020, which is hereby expressly incorporated by reference in its entirety for all purposes.

BACKGROUND

This disclosure relates in general to transportation systems and, but not by way of limitation, to tracking and authorizing a transit user for passing through fare gates of a transit system.

In public transportation, fare gates are used to stop passengers that have not yet paid for a valid ticket to enter certain areas within the transportation system. The fare gates normally require ticket validation on a validator mounted to the fare gates, which can result in slower throughput (e.g., line/queue formation at the fare gates).

Waiting in long queues at the fare gates can be a stressful experience for passengers. Congestion can result in suboptimal throughput for fare gates. Verifying fare causes friction and can be confusing for infrequent riders. Even though there are contactless fare cards, they must be placed very close to the validator such that most riders touch the validator. This touch-point can be a place for spreading of disease, for example, viruses.

SUMMARY

In one embodiment, the disclosure provides a transit system including an access control point, a positioning system, a tracking system, and a server. The access control point provides a passage to a transit user for taking a trip through the transit system. The server receives a first location and visual cues of the transit user. The first location is determined using the positioning system and a mobile device. Candidate locations and visual cues of other transit users are obtained from the tracking system. The server correlates the first location to a candidate location and compares the visual cues of the transit user with the other transit users. A correlated location is determined, the first location and the visual cues of the transit user are verified. The server verifies terms of a transit pass of the transit user. Based on the verification, usage of the transit pass is allowed for passing through the access control point.

In another embodiment, the disclosure provides a transit system for a transportation system. The transit system includes an access control point, a positioning system, a tracking system, and a server. The access control point is configured to provide an access through the transit system. The positioning system is configured to identify a first location of a transit user based on radio frequency (RF) information received from a mobile device. The tracking system is configured to provide a plurality of candidate locations and a plurality of candidate identifiers for one or more transit users, and visual cues of the transit user. The server is configured to track the transit user within the transit system. The transit user is tracked by the server configured to obtain the first location and the visual cues of the transit user. The first location is located within a certain area of the transit system. The plurality of candidate locations and the plurality of candidate identifiers for the one or more transit users are obtained by the server from the tracking system. The plurality of candidate locations are locations of the one or more transit users located within the certain area of the transit system and the plurality of candidate identifiers are one or more visual cues of the one or more transit users. The first location is correlated to a candidate location of the plurality of candidate locations. A correlated location of the transit user is determined based at least in part on the first location and the candidate location. The visual cues of the transit user are compared with the plurality of candidate identifiers. The first location of the transit user is verified based on the correlated location. And the visual cues of the transit user are verified based on the comparison of the visual cues with the plurality of candidate identifiers. The correlated location is updated based on a change in the first location of the transit user. The server further receives a transit pass from the transit user and verifies terms of the transit pass for a current trip through the transit system using the access control point. The transit user is authorized based on the verification of the terms of the transit pass to allow usage of the transit pass for the current trip through the transit system until the usage expires for the current trip.

In still embodiment, the disclosure provides a method of operating an access control point within a transit system. In one step, a transit user is tracked within the transit system. A first location and visual cues of the transit user are obtained. The first location is located within a certain area of the transit system, and the first location is based on radio frequency (RF) information received from a mobile device. A plurality of candidate locations and a plurality of candidate identifiers for one or more transit users are obtained from a tracking system. The plurality of candidate locations are locations of the one or more transit users located within the certain area of the transit system and the plurality of candidate identifiers are one or more visual cues of the one or more transit users. The first location is correlated to a candidate location of the plurality of candidate locations. A correlated location of the transit user is determined based at least in part on the first location and the candidate location. The visual cues of the transit user are compared with the plurality of candidate identifiers. The first location of the transit user is verified based on the correlated location. And the visual cues of the transit user are verified based on the comparison of the visual cues with the plurality of candidate identifiers. The correlated location is updated based on a change in the first location of the transit user. A transit pass is received from the transit user. Terms of the transit pass are verified for a current trip through the transit system using the access control point. The transit user is authorized based on the verification of the terms of the transit pass to allow usage of the transit pass for the current trip through the transit system until the usage expires for the current trip.

In an embodiment, the disclosure provides software to cause the transit system to:

track a transit user within the transit system by the transit system cause to;

obtain a first location and visual cues of the transit user, the first location is located within a certain area of the transit system, and the first location is based on radio frequency (RF) information received from a mobile device;

obtain a plurality of candidate locations and a plurality of candidate identifiers for one or more transit users from a tracking system, the plurality of candidate locations are locations of the one or more transit users located within the certain area of the transit system and the plurality of candidate identifiers are one or more visual cues of the one or more transit users;

correlate the first location to a candidate location of the plurality of candidate locations;

determine a correlated location of the transit user based at least in part on the first location and the candidate location;

compare the visual cues of the transit user with the plurality of candidate identifiers;

verify both: the first location of the transit user based on the correlated location, and the visual cues of the transit user based on the comparison of the visual cues with the plurality of candidate identifiers; and update the correlated location based on a change in the first location of the transit user;

receive a transit pass from the transit user;

verify terms of the transit pass for a current trip through the transit system using the access control point; and authorize the transit user based on the verification of the terms of the transit pass to allow usage of the transit pass for the current trip through the transit system until the usage expires for the current trip.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with appended figures.

In the appended figures, similar components and/or features may have the same reference label. Further, various components of the same type may be distinguished by following the reference label by a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment. It is understood that various changes may be made in the function and arrangement of elements without departing from the spirit and scope as set forth in the appended claims.

Figure 1:
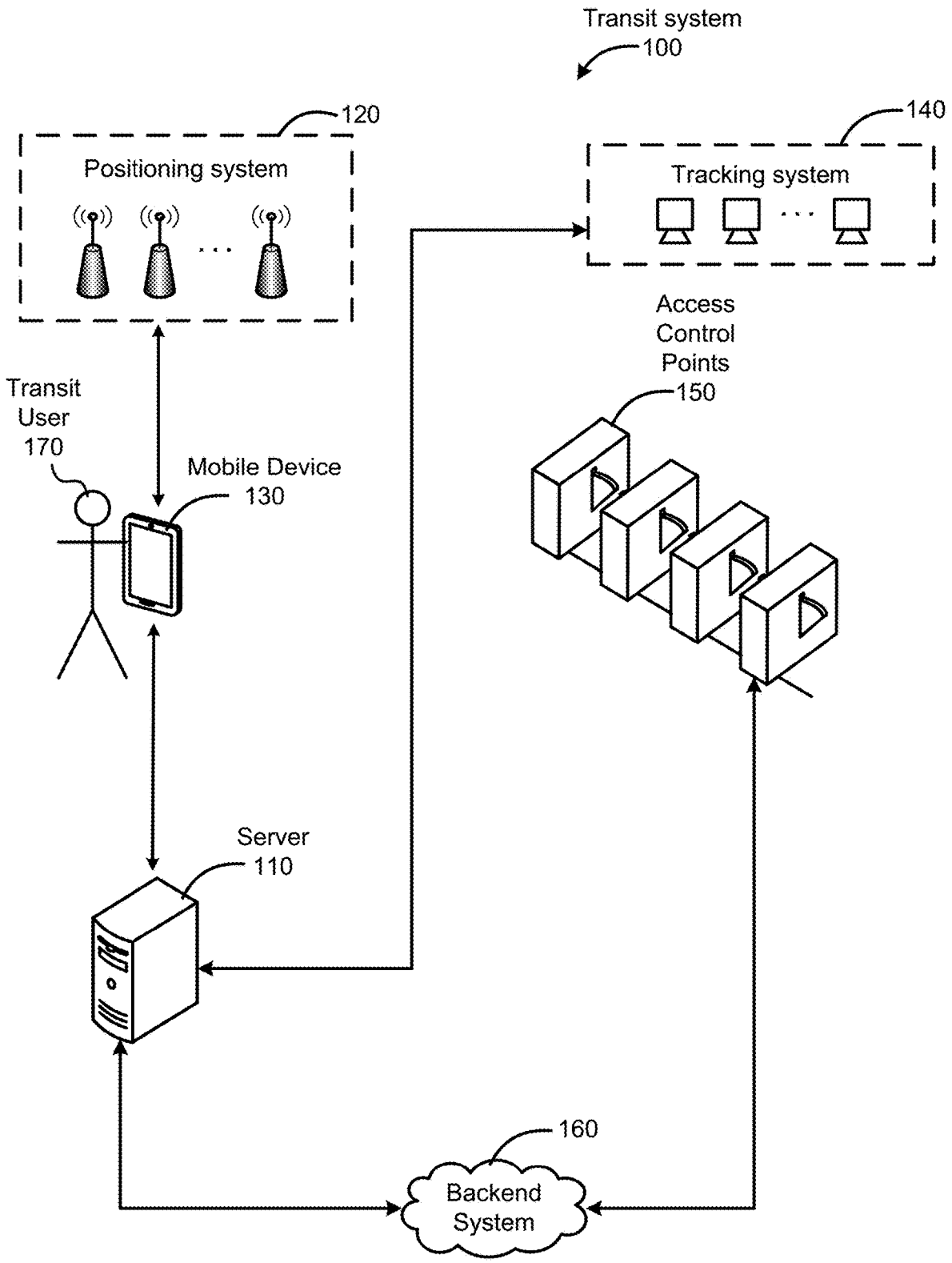
FIG. 1 depicts a block diagram of an embodiment of a transit system.

Referring initially to FIG. 1, an embodiment of a transit system 100 is illustrated. The transit system 100 includes a server 110, a positioning system 120, a mobile device 130, a tracking system 140, access control points 150, a backend system 160, and a transit user 170. The transit system 100 may be within a transportation system such as railway, subway, metro rail, bus system, and/or ferries. The positioning system 120 is in communication with the mobile device 130. The transit system 100 may include additional or alternative components, including intermediate components within the communication links (e.g., relays, servers, data networks—such as the Internet, etc.), additional access control points 150, servers 110, etc. in other stations throughout the transportation system. The mobile device 130 may belong to a transit user 170 and therefore may not be considered part of the transit system 100 itself, but rather interacting with the transit system 100. Moreover, although a single mobile device 130 is illustrated, it will be understood that a number of mobile devices 130 may interact with the transit system 100.

In addition to the access control points 150, many of the other components of the transit system 100 may be co-located to a particular location (e.g., station, platform, etc.) within the transportation system. For example, some or all of the components of the positioning system 120 and/or tracking system 140, which may communicate directly with the mobile device 130 and/or may track the transit user 170 may be located at or near a transit station in which the access control points 150 are located. In some embodiments, the server 110, too, may be located local to the transit station or remote connected by a LAN or WAN.

The access control points 150 may be one of fare gates, security gates, entry points, or a passage within the transit system 100. In another embodiment, the access control points 150 may be a physical obstruction that is "opened" by moving and/or unlocking the physical obstruction. In other embodiments an access control point 150 may include a walkway, zone, or a threshold across which the transit user 170 walks, without obstruction, from one area within the transit system 100 to another. In such instances, other embodiments may indicate to a user (via light, sound, etc.) that payment for passing through the access control point 150 has been made or will be made upon the transit user 170 passing through the access control point 150. Embodiments allow removal of the access control points 150 altogether.

The transit system 100 may allow tracking of the transit user 170 at the access control points 150, the transit station, and/or a line near the access control points 150 within the transit system 100. In alternative applications the access control points 150 may be located, at entrance of buses, concert venues, sports venues, museums, etc. The tracking system 140 could stop tracking transit users 170 once they exit the transit system 100 and erase any tracking information if their fare is over. For example, tracking could occur on several subway transfers and a bus ride for a two hour pass until that time expires. Continued use would require another pass to activate in a new session separate from the first.

The transit system 100 tracks the transit user 170 and validates payment, fare or ticket for taking a trip through the transit system 100. The transit user 170 is able to simply walk up to and pass through the access control point 150 within the transit system 100 upon validation.

The transit system 100 may allow the transit user 170 with the mobile device 130 to pass through the access control point 150 after validating a transit pass of the transit user 170. The mobile device 130 may include an electronic device owned (or otherwise operated) by the transit user 170, such as a mobile phone, smart phone, tablet, or the like. To communicate with the server 110 and the positioning system 120, the mobile device 130 may execute a software application (or "app"). Depending on desired functionality, the mobile device 130 may begin communicating with the server 110 triggered by the positioning system 120 or a geo fence using cellular, Bluetooth™ and/or WiFi. The communication is based on the mobile device 130 being within a certain proximity of the transit system 100, detecting wireless access points or transmissions from other wireless sources known to be located at or near a transit system 100, and/or based on a user input activating their transit pass. For example, the transit user 170 manually evokes the application and/or provides the user input indicating that the mobile device 130 is at or near a transit system 100. Once at the transit system 100, the mobile device 130 provides the server 110 with updates of its location, based at least in part on the positioning system 120. Additionally, the mobile device 130 may provide identification information, such as ticketing or account information, to the server 110.

The transit user 170 with the mobile device 130 enters and travels through the transit system 100 in which the access control points 150 are located. The mobile device 130 determines its position using the positioning system 120 and provides its position information to the server 110. Additionally, the server 110 acquires location information for transit users 170 within the transit system 100 from the tracking system 140. Using the location and position information, the server 110 compares the location of the mobile device 130 with the position of the transit user 170 as provided by the tracking system 140.

Depending on desired functionality, location updates from the mobile device 130 are provided to the server 110 in different ways. In an embodiment, the location updates are provided at a given rate for example, once per second, twice per second, or the like. In another embodiment, the location updates may be provided based on triggers, such as velocity and/or location. By way of an example, the transit user 170 moving at a certain speed, enters a certain location of the transit system 100. The location of the mobile device 130 may be determined using hardware and/or software components of the mobile device 130 and/or hardware and/or software components of a separate module communicatively coupled to the mobile device 130. For example, a separate electronic positioning device or tag connected to the mobile device 130 via wireless or wired means.

The positioning system 120 includes one or more radiofrequency (RF) transceivers or transmitters that allow the mobile device 130 to determine its location within the transit system 100. For example, WiFi access points, Bluetooth or other RF beacons. By taking measurements of wireless signals from the positioning system 120, the mobile device 130 and/or positioning system 120 can determine the location of the mobile device 130 using triangulation, trilateration, dead reckoning, and/or similar techniques. The measurements of wireless signals may include round-trip time (RTT) determination, Received Signal Strength Indicator (RSSI), passive radar, or the like. The mobile device 130 can then relate its location to the server 110.

In other embodiments, the transit system 100 may additionally or alternatively use a positioning system 120 that does not include RF transceivers/transmitters local to the transit system 100. In some embodiments, for example, non-RF beacons may be used for example, utilizing infrared, ultrasound, or other wireless positioning means. In other embodiments, the positioning system 120 may include components of a separate positioning system, such as a cell phone positioning system. For example, utilizing mobile device positioning based on communication with cell phone base stations and/or a satellite positioning system (e.g., Global Positioning System (GPS)) if the mobile device 130 is able to determine its location based on GPS signals (which may be available in instances where the transit system 100 is located outdoors).

Along with its location and a timestamp indicative of a time at which the location was determined, the mobile device 130 may provide identification information to the server 110 that allows the server 110 to link the mobile device 130 to an account or ticket for payment of a transit fare. This information, which may be encrypted to help ensure privacy/security, can include, for example, a name or other identifier of the person, a credit card number, account number, ticket number, username, phone number, or other unique identifier.

In addition to receiving the location of the mobile device 130 and other mobile devices (not shown) at the transit system 100, the server 110 receives location information of the transit users 170 within the transit system 100 from the tracking system 140. The tracking system 140 includes one or more cameras capable of identifying transit users 170 within captured images or videos, determining the respective locations of the transit users 170, and providing the respective locations to the server 110. The tracking system 140 further provides tracking movement of the transit users 170, thereby allowing the server 110 to follow the movement of each of the transit users 170 through the transit system 100. For example, facial tracking could be used by video cameras positioned throughout the transportation system. Depending on desired functionality, the cameras utilized by the tracking system 140 may comprise infrared cameras, RGB cameras, 360 degree cameras, PZT cameras, CCTV, or the like.

The tracking system 140 may identify individual transit users 170 from a heat signature, pixel blob detection, or other techniques that do not determine an individual's personal identity. The tracking system 140 may further identify the transit users 170 using a unique identifier, and provide the unique identifier to the server 110. The tracking system 140 may identify personally-identifying features, such as facial recognition, attire, and/or accessories depending on applicable laws/regulations, user preferences/authorization, and/or other factors. For embodiments that use personal identification from the tracking system 140, the personal identification could be erased after the current session enabled by their fare expires or they leave the transportation system. For example, facial recognition would store images and dimensions for the transit user's face along with tracking information that would be erased after they arrive at their destination.

Based on the location information from the mobile device 130 and the position information from the tracking system 140, the server 110 correlates the location information to verify the location of the mobile device 130 within the transit system 100. The server 110 uses the location provided by the mobile device 130 and/or positioning system 120 to correlate the location of the mobile device 130 to a position of the corresponding transit user 170 tracked by the tracking system 140. Based on the determination the location of the mobile device 130 is further determined to be within a certain distance from the access control points 150. The unique identifier of the transit user 170 is compared with the unique identifiers of the other transit users 170. The server 110 identifies the unique identifier of the transit user 170 based on the comparison of the unique identifiers.

After verification, the transit user 170 provides a transit pass to use the access control points 150 to travel through the transit system 100. The transit pass has terms and conditions like credit amount, rides remaining, pass terms or privileges, and/or use coupon. The terms of the transit pass are verified by the server 110 and the user is allowed to pay for a current trip through the transit system 100. The backend system 160 enables the transit user 170 to make payment for the current trip. Other embodiments allow the transit pass to be electronic and managed in the app on the mobile device 130 that communicates with the server 110 to allow hands-free authorization without even removing the mobile device 130 to pass through the access control point 150 and remainder of the transportation system as authorized by their transit pass.

The server 110 tracks the transit user 170 through the transit system 100 and, if the transit user 170 is within the certain distance from one of the access control points 150, the transit user 170 is allowed passage through one of the access control points 150 without presenting a fare pass to provide touchless passage. In case the access control point 150 is a gate, the access may be provided by opening the respective gate, barriers, or paddles. When the transit pass expires for the current trip, or when the transit user 170 passes through the access control point 150 upon exit from the transportation system, the server 110 stops tracking the location of the transit user 170. Any facial or other personal details are forgotten once the tracking stops.

Where touchless verification of the transit pass is not enabled for a transit user 170 (perhaps because their phone is not working or they don't have a valid pass), the transit user 170 may encounter barriers, gates and/or paddles that prevent passing through the access control points 150. Once remedied, the tracking system 140 can allow further passage unimpeded through the transportation system.

Figure 2:
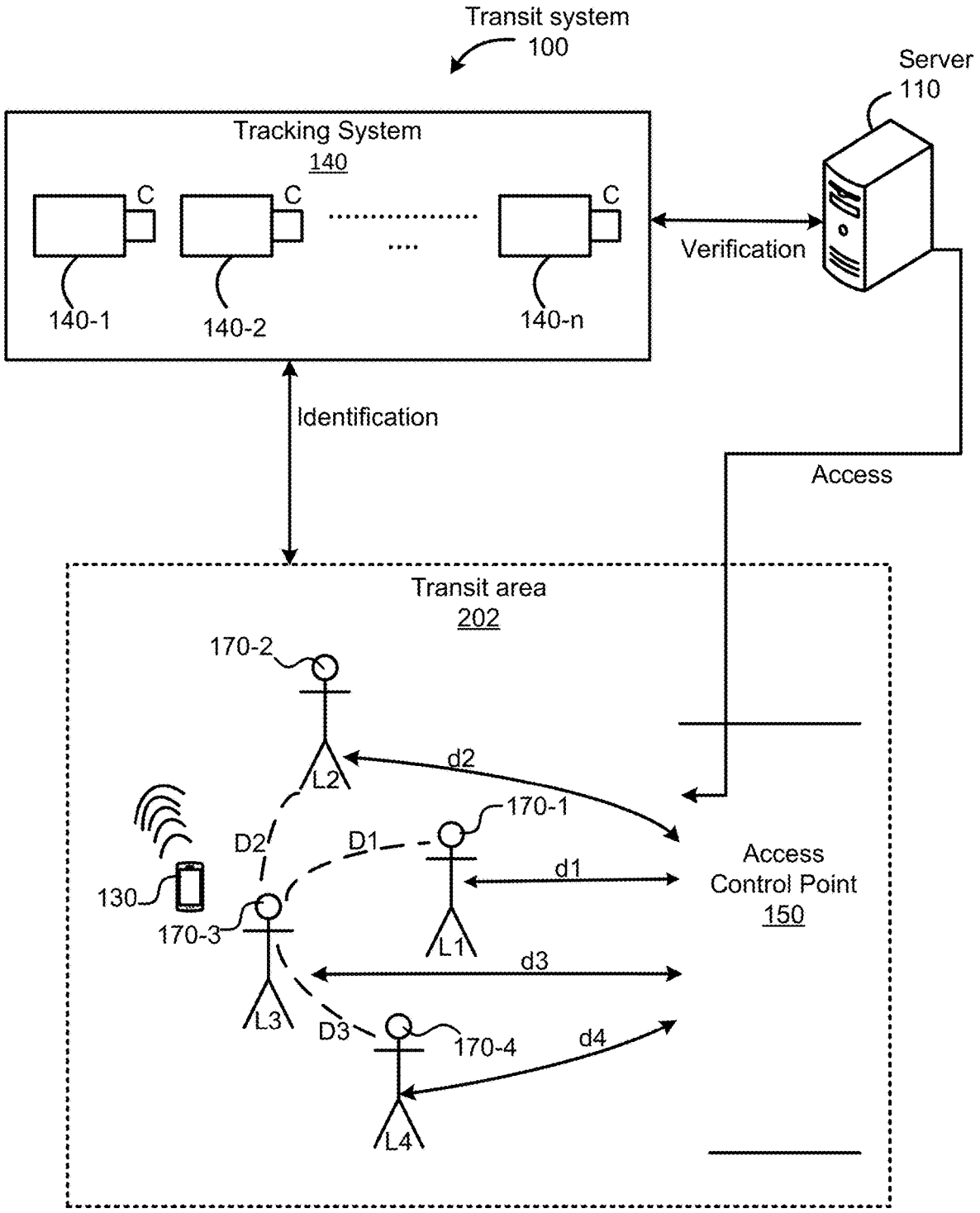
FIG. 2 depicts a block diagram of an embodiment of the transit system.

FIG. 2 is an embodiment of a functional block diagram illustrating the identifying of the transit user 170 and providing access to the transit user 170 for passage through an access control point 150 of the transit system 100. The transit system 100 includes a transit area 202. The transit area 202 is proximate to the entry for the access control point 150. A plurality of transit users 170 including a first transit user 170-1, a second transit user 170-2, a third transit user 170-3, and a fourth transit user 170-4, approach the entrance of the access control point 150 for passing through to gain access to the transit system 100. For transportation systems that regulate exit, a similar transit area 202 would exist.

The first transit user 170-1 is at a distance of d1 from the access control point 150, the second transit user 170-2 is at a distance of d2, the third transit user 170-3 is at a distance of d3, and the fourth transit user 170-4 is at a distance of d4 from the access control point 150. The first transit user 170-1 is at a candidate location L1, the second transit user 170-2 is at a candidate location L2, the third transit user 170-3 is at a candidate location L3, and the fourth transit user 170-4 is at a candidate location L4. The transit users 170 who are within a predetermined distance from the third transit user 170-3 are identified, the third transit user 170-3 provides its location to the server 110 using the mobile device 130. The first transit user 170-1, the second transit user 170-2, and the fourth transit user 170-4 are within the predetermined distance to the third transit user 170-3.

Distances between the third transit user 170-3 and the second transit user 170-2, the first transit user 170-1, and the fourth transit user 170-4 are determined. Distance between the first transit user 170-1 and the third transit user 170-3 is D1, the distance between the second transit user 170-2 and the third transit user 170-3 is D2, and the distance between the fourth transit user 170-4 and the third transit user 170-3 is D3. The distances D1, D2, D3 are compared to a predetermined proximity threshold to determine that the shortest distance among the distances D1, D2 and D3. The third transit user 170-3 uses the mobile device 130 to provide a mobile device location to the server 110. The third transit user 170-3 may use the positioning system 120 to determine the mobile device 130 location.

The tracking system 140 tracks the plurality of transit users 170 in the transit area 202 using one or more cameras 140-1, 140-2, . . . **140-*n* or sensors (not shown). The tracking system 140 identifies the candidate locations L1, L2, L3, and L4 of the first transit user 170-1, the second transit user 170-2, the third transit 170-3, and the fourth transit user 170-4, respectively. The tracking system 140 further identifies each of the transit users 170** based on their respective visually identifying features such as attire, body movements, luggage, phones, and/or facial features. The identification and temporary storage and use of the visually identifying features are in accordance with appropriate privacy laws, rules and/or regulations, and/or based on user authorization. Where temporary identification and tracking is not allowed or authorized by the user, traditional proximity cards at readers on fare gates may be used.

The server 110 receives the mobile device location from the mobile device 130 and correlates the mobile device location with the candidate locations L1, L2, L3, and L4. Based on the correlation, the server 110 identifies a match of the mobile device location with the candidate location L3 and determines a correlated location. The correlated location being the location of the third transit user 170-3. The server 110 further compares the visually identifying features of the third transit user 170-3 with the visually identifying features of the first transit user 170-1, the second transit user 170-2, and the third transit user 170-4 to uniquely identify each of the transit users 170.

The server 110 verifies that the mobile device location is associated with the third transit user 170-3. The mobile device location of the third transit user 170-3 is verified based on the correlated location. The server 110 verifies the visually identifying features of the third transit user 170-3 based on the comparison of the visually identifying features of the third transit user 170-3 with the visually identifying features of the first transit user 170-1, the second transit user 170-2, and the fourth transit user 170-4. The server 110 provides the verification to the third transit user 170-3 by transmitting a notification on the mobile device 130 of the third transit user 170-3.

The server 110 continuously tracks the mobile device 130 location of the third transit user 170-3 based on a change in the location of the third transit user 170-3 as the third transit user 170-3 walks across the transit area 202. All transit users 170 are tracked over time and the association of mobile device 130 and fare pass becomes more accurate as movements are very different over time for each transit user 170. At some point of tracking over time, all transit users with mobile phone apps can be disambiguated from each other to positively know what phone 103 is for what transit user 170.

On receiving the verification on the mobile device 130, the third transit user 170-3 provides a transit pass or other authorization to the server 110. The server 110 verifies the terms of the transit pass of the third transit user 170-3 and based on the verification authorizes the third transit user 170-3 to pass through the access control point 150. The verification of the terms of the transit pass includes checking minimum balance or amount for a current trip, any privileges associated with the transit pass such as for children and/or senior citizens, and/or a gift coupon attached with the transit pass for payment. In case the transit pass does not have the minimum balance amount or remaining rides, or the third transit user 170-3 desires to directly pay for the current trip or recharge the transit pass, the server 110 authorizes the third transit user 170-3 to make the payment instantly on their phone or a payment kiosk. A payment link may be sent to the mobile device 130 or the amount may be paid using a mobile application. After the payment is complete and/or the terms of the transit pass are verified, the third transit user 170-3 is authorized by the server 110 to pass through the access control point 150 using the transit pass.

After the third transit user 170-3 has passed through the access control point 150 and/or has used the transit pass for the current trip, the tracking system 140 stops tracking the location of the third transit user 170-3. Temporary identifiers of the third transit user 170-3 such as the visually identifying features may be removed from storage of the tracking system 140 after the third transit user 170-3 have used the transit pass and/or have passed through the access control point 150. Some embodiments keep the temporary identifiers while the transit user is in the transportation system or their redeemed fare is still valid.

Figure 3:
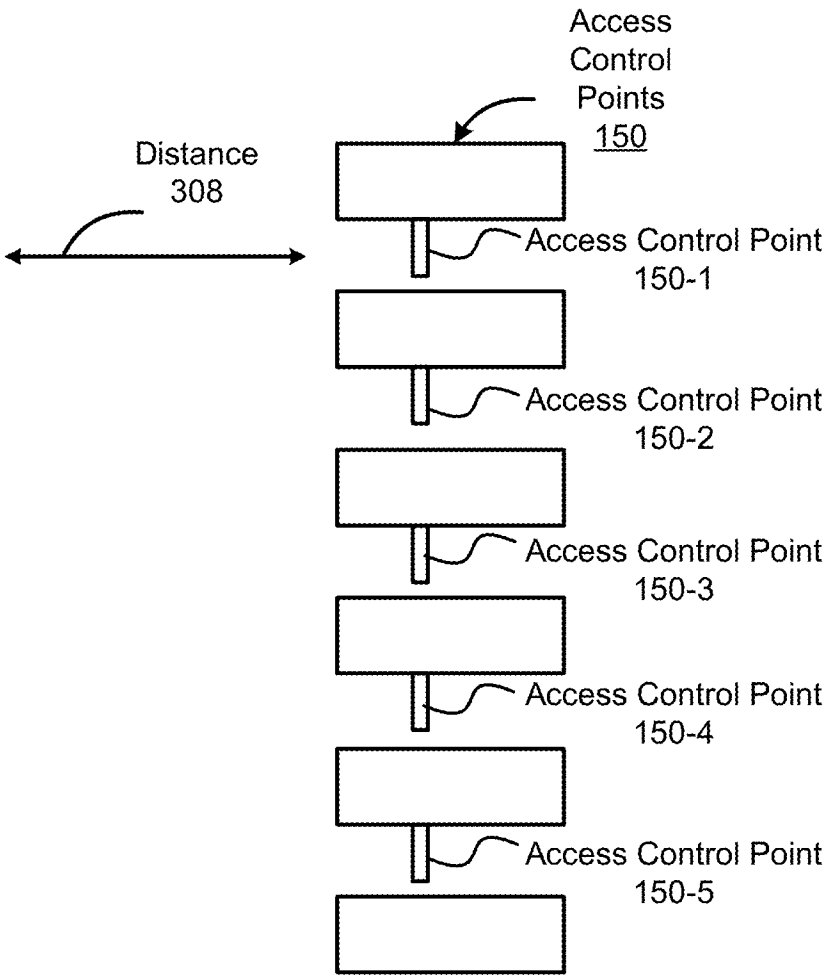
FIG. 3 depicts a block diagram of an embodiment of the transit system.
Figure 3:
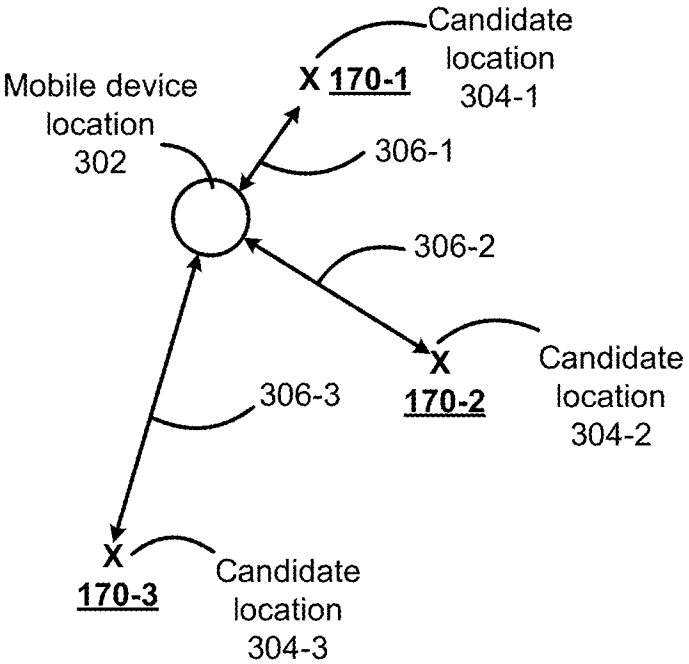

FIG. 3 is an embodiment of a functional block diagram illustrating the location identification of the mobile device 130 within the transit system 100. A mobile device location 302 is the location at which the server 110 determines a location of the mobile device 130 based on location information provided by the mobile device 130. The location information is determined using the positioning system 120. Candidate locations 304-1, 304-2, and 304-3 represent the locations of nearby transit users 170-1, 170-2, and 170-3, as determined by the tracking system 140. Each candidate location 304 is a candidate for correlation with the mobile device location 302. In alternative embodiments, multiple mobile device locations 302 may be correlated with one candidate location 304 from the tracking system 140. The server 110 correlates the mobile device location 302 for each of the mobile devices 130 within the transit system 100 with a corresponding candidate location 304 obtained from the tracking system 140. Moreover, the server 110 may employ optimization techniques to reduce the number of candidate locations 304 for which a respective distance 306 from the mobile device location 302 is calculated, eliminating the least-likely candidates. For example, by splitting an area off into different regions, or the like.

After receiving a mobile device location 302, the server 110 correlates the mobile device location 302 to a candidate location 304 based on the candidate location 304 having a shortest distance to the mobile device location 302. The server 110 computes the distances 306. The respective distance 306-1 of the first candidate location 304-1 is shorter than the distance 306-2 of the second candidate location 304-2 and the distance 306-3 of the third candidate location 304-3. The server 110 correlates the candidate location 304-1 to the mobile device location 302. The server 110 identifies that the first transit user 170-1 at the first candidate location 304-1 as provided by the tracking system 140 is carrying the mobile device 130.

Additionally or alternatively, the server 110 correlates the mobile device location 302 to a candidate location 304 based on an absolute distance, if the candidate location 304 is within a threshold distance to the mobile device location 302. Other embodiments may use both: correlating a candidate location 304 with the mobile device location 302 if (1) the candidate location 304 is the shortest of all candidate locations 304, and (2) the corresponding distance 306 is within the threshold distance.

The server 110 performs the correlation for each mobile device 130 for which the server 110 receives the mobile device location 302, and may do so frequently for example, at a rate of once per second, or multiple times per second in order to track the transit users 170 throughout the transit system 100. Any presumed correlation is updated over time to increase the accuracy of the disambiguation.

Depending on desired functionality, an actual location of the first transit user 170-1 that is the correlated location is determined by the server 110 based on the correlated candidate location 304-1, the mobile device location 302, or both. By way of an example, if the mobile device location 302 is determined by the server 110 to be less accurate than the corresponding candidate location 304-1 provided by the tracking system 140, the server 110 may determine the correlated location to be at the candidate location 304-1. Similarly, the mobile device location 302 is used if it is determined to be more accurate. The accuracy is determined based on comparison with of the mobile device location 302 and the candidate location 304-1 to the correlated location of the first transit user 170-1. Alternatively, the correlated location of the first transit user 170-1 may be determined to be a weighted average of the mobile device location 302 and corresponding candidate location 304-1.

When the server 110 determines the correlated location of the first transit user 170-1 to be within a distance 308 of the access control point 150, the server 110 may then work with the backend system 160 to open the access control point 150 for the first transit user 170-1. For example, if the server 110 determines that the correlated location of the first transit user 170-1 is within the distance 308 of the access control point 150-1, the server 110 may communicate to the backend system 160 to open the access control point 150-1. In some embodiments, the access control point 150-1 may provide a visual or audio indication to the first transit user 170-1 that the access control point 150-1 has been opened. The indication may include a light, calling the first transit user's 170-1 name, ticket or pass number or other identifier on a display at the access control point 150-1. The server 110 may directly interact with the access control point 150-1 to open the access control point 150-1.

The backend system 160 (including one or more computer servers, which may be remote from the transit system 100 at which the access control point 150 are located) operates to open the access control point 150-1 when the correlated location of the first transit user 170-1 is within the distance 308. Depending on a method of payment, the first transit user 170-1 pays for the transit ticket, the transaction may involve crediting and/or debiting a user transit account, bank/credit card account, or the like, which may involve communicating with third parties (e.g., a bank, credit/debit card company, stored value account, etc.). Furthermore, the backend system 160 may verify that the first transit user 170-1 has passed through the access control point 150-1 using information from the access control point 150-1 for example, the information obtained by sensors (not shown) at the access control point 150-1 and/or the server 110.

Figure 4:
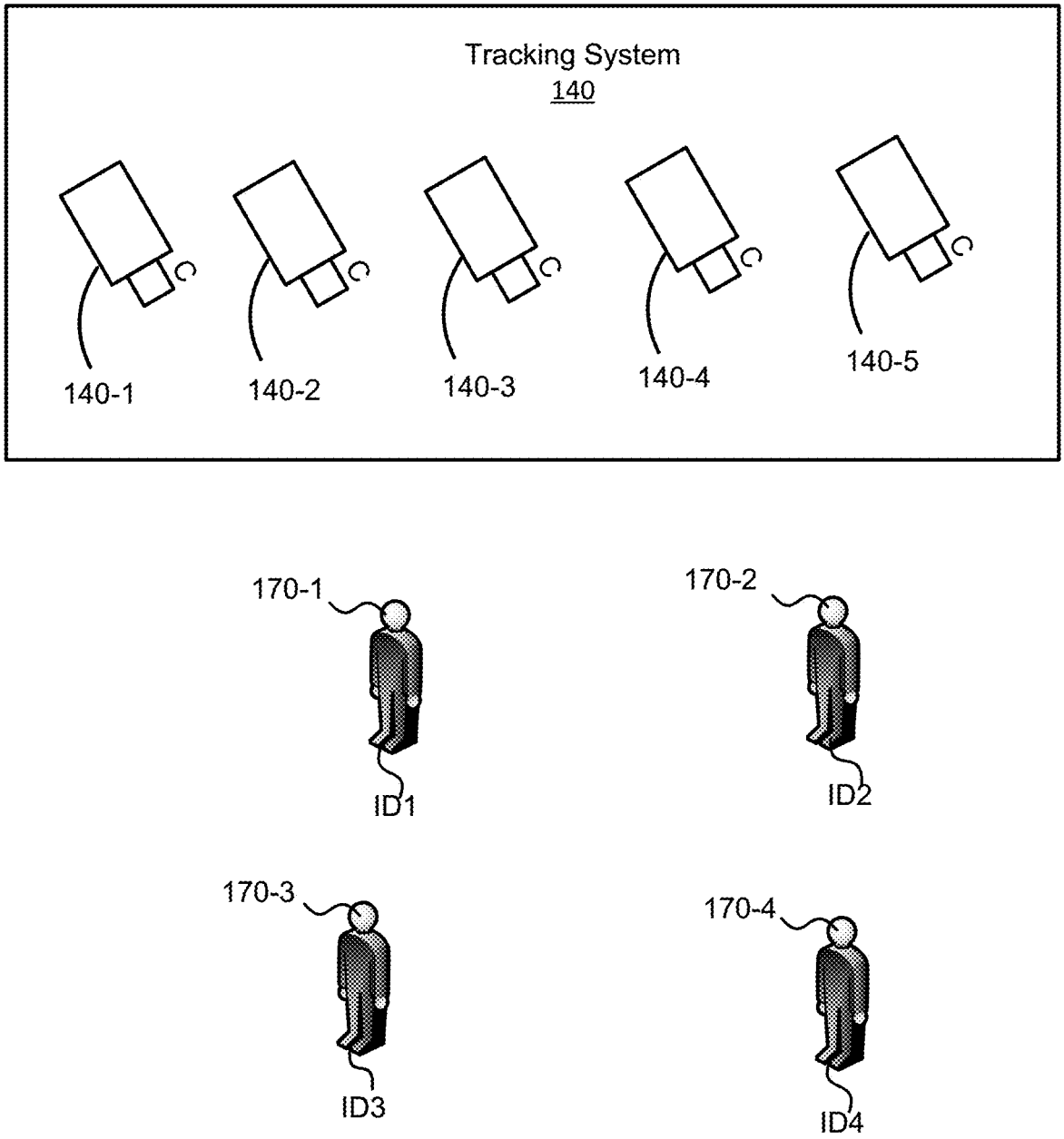
FIG. 4 depicts a block diagram of an embodiment of the transit system.

FIG. 4 is an embodiment of a functional block diagram illustrating extraction of visually identifying features of transit users 170 within the transit system 100. The tracking system 140 extracts the visually identifying features of each of the transit users 170 within the transit system 100 approaching the access control points 150 or as they pass any cameras in the tracking system 100. The visually identifying features may include at least one of facial features, clothes, shoes, bags, luggage, phone, walking style and/or other uniquely identifying features. A temporary identifier may be assigned to each transit user 170 based on the respective visually identifying features. The visually identifying features are extracted, temporary stored, and used for comparison against the visually identifying features of other transit users 170. However, after a transit user 170 has passed through the access control point 150 and been authorized by the server 110, the tracking system 140 stops tracking the visually identifying features of the transit user 170 and deletes the features temporary stored in the tracking system 140. Other embodiments may keep the features while the transit user 170 is using the transportation system or until the fare expires.

The tracking system 140 extracts the visually identifying features of the transit users 170 according to local and state laws, rules, and/or regulations, or based on user permission to maintain privacy and security of the transit users 170. In another embodiment, the tracking system 140 may not extract the facial features of the transit users 170 and extract other features like clothes, shoes, bag, and/or phone.

Transit users 170-1, 170-2, 170-3, and 170-4 comprise a set of transit users 170 tracked by the tracking system 140. The tracking system 140 uses a number of cameras 140-1, 140-2, 140-3, 140-4 and 140-5 or sensors to track the transit users 170. Each of the transit users 170-1, 170-2, 170-3, and 170-4 have their respective unique features. The temporary identifier assigned to each of the transit users 170-1, 170-2, 170-3, and 170-4 by the tracking system 140 are ID1, ID2, ID3, and ID4, respectively.

Figure 5:
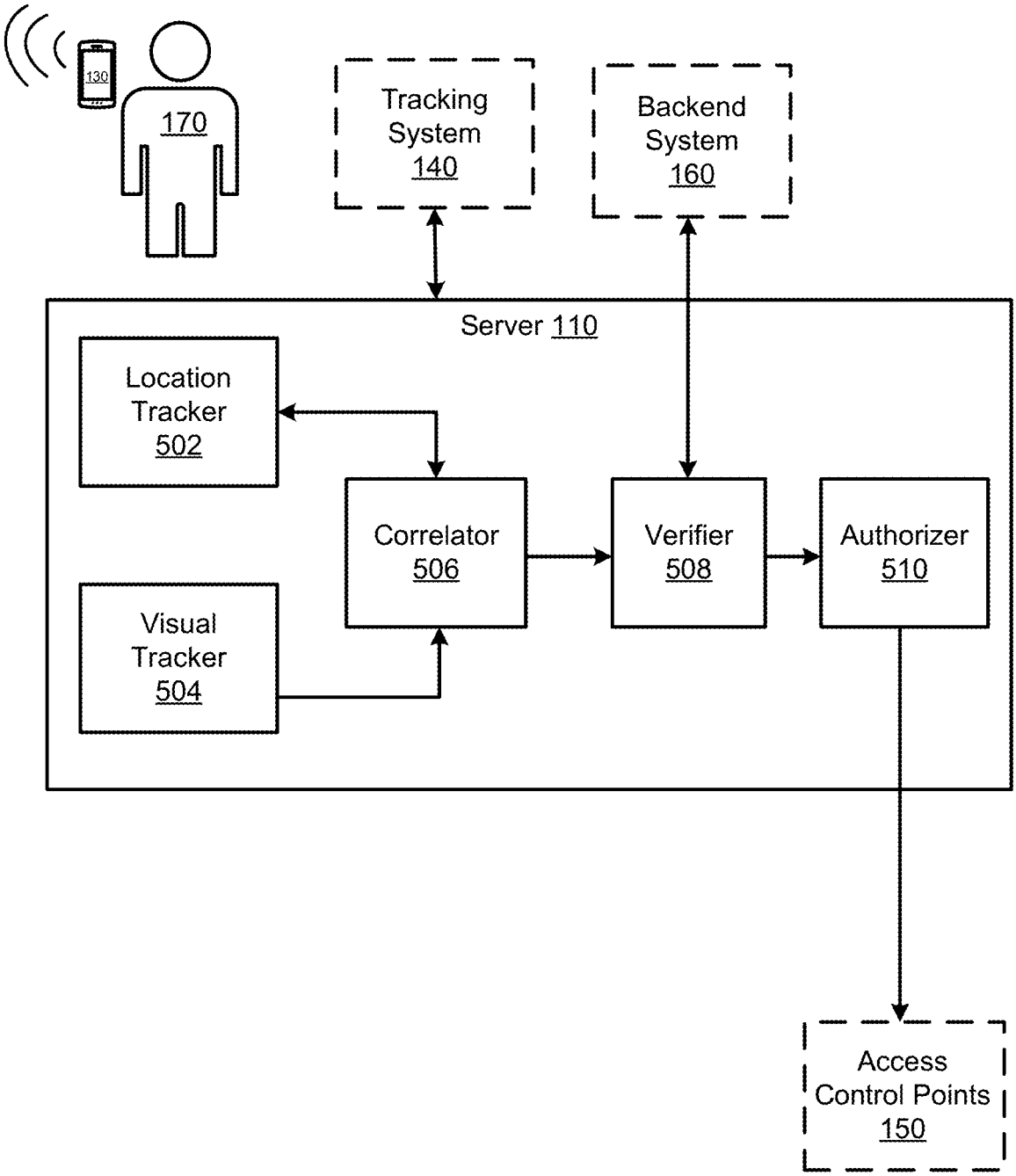
FIG. 5 depicts a block diagram of an embodiment of a server of the transit system.

FIG. 5 illustrates one embodiment of the server 110 configured to track the transit user 170 based on the correlated location and the visually identifying features, and further verify the transit user 170 to pass through the access control points 150. The server 110 includes a location tracker 502, a visual tracker 504, a correlator 506, a verifier 508, and an authorizer 510. The transit user 170 uses the mobile device 130 to transmit it's location to the server 110. In this example, the transit user 170 desires to take trip through the transit system 100 by using the access control points 150 which may be at entry, exit, and/or transfer points. The transit user 170 and the other transit users 170 (not shown) are within a certain area of the transit system 100.

The location tracker 502 receives the location from the transit user 170. The location tracker 502 also receives the candidate locations 304-1, 304-2, and 304-3 of the other transit users 170 who are within a threshold distance from the transit user 170. The tracking system 140 provides the candidate locations 304 of the transit users 170 to the location tracker 502. The tracking system 140 extracts the candidate locations 304 of the transit users 170 using a plurality of cameras. The candidate locations 304 of the transit users 170 are provided to the correlator 506 for further processing.

The visual tracker 504 receives the visually identifying features of the transit users 170 from the tracking system 140. The visually identifying features include attire, body movements, luggage, phones, and/or facial features of the transit users 170. Identification, storage, and/or usage of the visually identifying features are based on government laws, rules and/or regulations, or user authorization. The visually identifying features of the transit users 170 are extracted using the plurality of cameras of the tracking system 140. The visually identifying features of the transit users 170 are provided to the correlator 506 for further processing.

The correlator 506 compares the location of the transit user 170 with each of the candidate locations 304-1, 304-2, and 304-3 of the other transit users 170. Based on the comparison, the location of the transit user 170 is correlated to the candidate location 304 based on the candidate location 304-1 having a shortest distance to the location. The correlator 506 generates a correlated location of the transit user 170 based on the correlation. The correlator 506 identifies that the transit user 170 is at the candidate location 304-1 provided by the tracking system 140 and is carrying the mobile device 130. The correlator 506 further compares the visually identifying features of the transit user 170 with the visually identifying features of the other transit users 170 to uniquely identify the transit user 170.

The location tracker 502 continuously tracks changes in the location of the transit user 170 and updates the correlated location based on those changes. The updated location is provided to the correlator 506 which compares it with the other candidate locations 304. Based on the comparison, the correlator 506 updates the correlated location of the transit user 170. The transit user 170 is therefore identified as an owner of the mobile device 130 which transmitted the location of the transit user 170. The correlator 506 provides the identification of the transit user 170 to the verifier 508 for further processing.

The verifier 508 on receiving the identification of the transit user 170, sends a notification on the mobile device 130 of the transit user 170 regarding the identification. The notification also includes a request for a transmit pass or other verification of the transit user 130. On receiving the notification, the transit user 170 provides the transmit pass to the verifier 130.

The verifier 508 extracts terms of the transit pass and further verifies the terms against a set of predetermined rules stored in the verifier 508. The terms of the transit pass include balance against a current trip, minimum balance for the current trip, privileges associated with the transit pass such as free or discounted ride for senior citizens, children, and/or passengers, or gift coupon associated with the transit pass. Verifying the terms of the transit pass validates that the transit user 170 has paid for the current trip and/or is privileged to take the current trip.

In case the transit user 170 has either not paid and/or is not privileged to take the current trip, the verifier 508 transmits a notification on the mobile device 130 of the transit user 170 to a make the payment for the current trip. The payment may be made using the backend system 160 that stores authorization information for transit users 170 and the rules associated with approving use. After verifying the terms of the transit pass and/or completion of the payment against the current trip of the transit user 170, the verifier 508 indicates its verification to the authorizer 510 for further processing.

The authorizer 510 determines whether the transit user 170 is within the certain distance from the access control points 150. The transit user 170 is validated by the authorizer 510 to pass through one of the access control points 150 based on the verification. The authorizer 510 sends a notification to the backend system 160 to provide access to the transit user 170. Sensors, motors and actuators of the access control points 150 are signaled by the backend system 160 to open when the transit user 170 is within the certain distance from the access control points 150. The transit user 170 traverses the access control point 150 using the transit pass after the access control point 150 is opened. After the transit user 170 has passed through the access control point 150 or has used the transit pass and/or the transit pass has expired for the current trip, the location tracker 502 stops tracking the location of the transit user 170 and the visual tracker 504 removes the visually identifying features of the transit user 170 that were temporarily stored.

Figure 6:
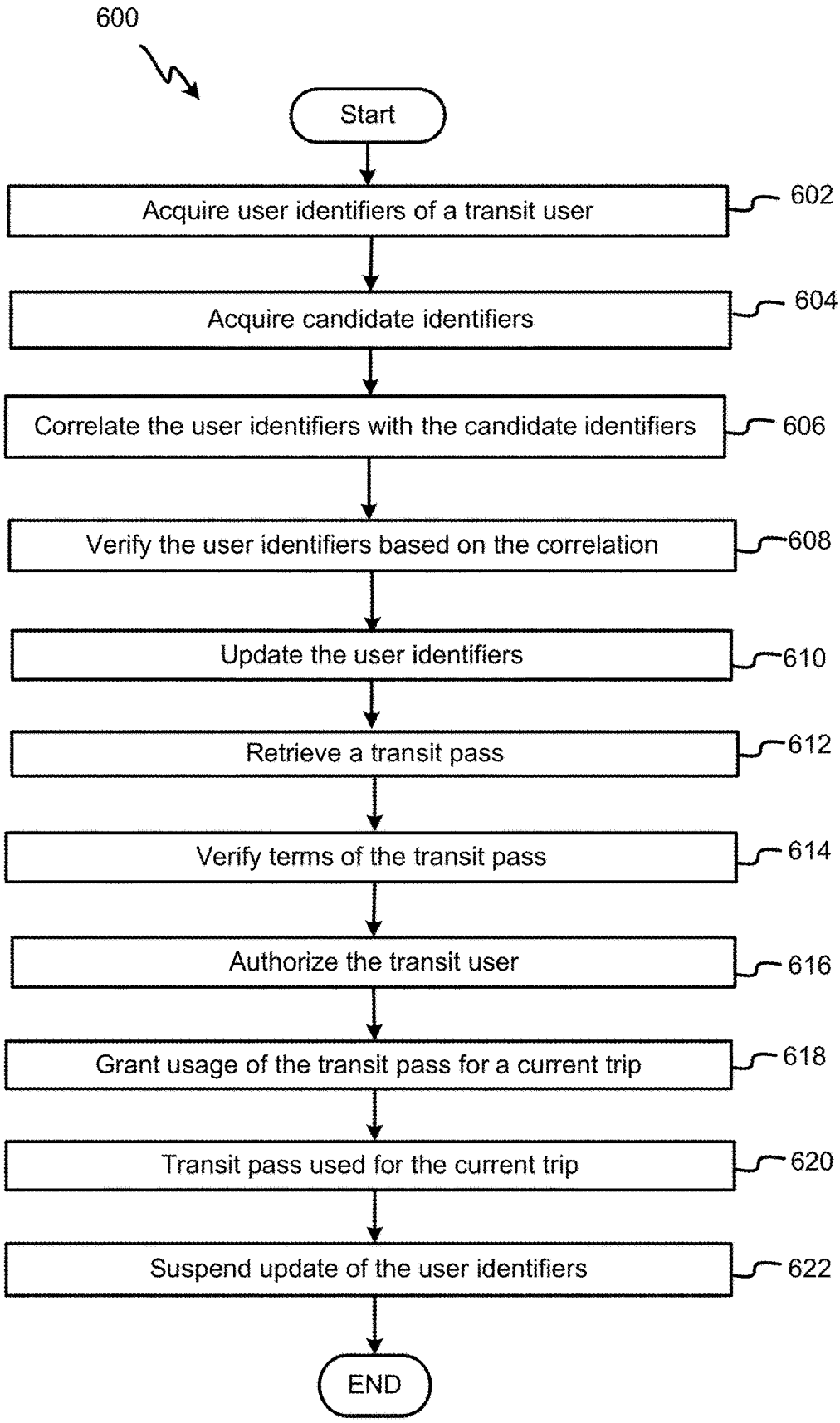
FIG. 6 illustrates a flowchart of an embodiment of a method for operating an access control point within the transit system.

FIG. 6 illustrates a method 600 for providing access to the transit user 170 for taking a trip through the transit system 100, according to an embodiment of the present disclosure. Transit users 170, including the transit user 170, approach the access control point 150 in order to access the transit system 100. The plurality of transit users 170 are within the certain transit area 202 of the transit system 100. The plurality of transit users 170 include a first transit user 170-1 at a candidate location 304-1, a second transit user 170-2 at a candidate location 304-2, and a third transit user 170-3 at a candidate location 304-3. The depicted portion of the method 600 starts at block 602 where user identifiers of the transit user 170 are acquired by the server 110. The user identifiers include a location of the transit user 170 and visually identifying features of the transit user 170. The transit user 170 uses the mobile device 130 and the positioning system 120 to determine the location. The transit user 170 transmits the location to the server 110 for identification. The visually identifying features of the transit user 170 are captured by the tracking system 140 using the one or more cameras and provided to the server 110.

At block 604, candidate identifiers of the plurality of transit users 170 are acquired by the server 110. The candidate identifiers include candidate locations 304 and the visually identifying features of the plurality of transit users 170. The tracking system 140 captures the candidate identifiers and provides it to the server 110. The plurality of transit users 170 are at a predetermined minimum distance from the transit user 170. That is, the candidate locations 304 are at the predetermined minimum distance from the location of the transit user 170.

At block 606, the candidate location 304-1 with a shortest distance to the location of the transit user 170 is correlated to the location of the transit user 170 by the server 110. A correlated location is generated based on the location of the transit user 170 and the candidate location 304-1.

At block 608, the server 110 verifies the location provided by the transit user 170 by matching it against the correlated location. The server 110 identifies based on the match that the first transit user 170-1 is at the location provided by the mobile device 130 and the first transit user 170-1 is the transit user 170. The server 110 further verifies the visually identifying features of the transit user 170 by comparing against the visually identifying features of the plurality of transit users 170. The transit user 170 is uniquely identified based on the correlated location and the visually identifying features.

At block 610, the server 110 receives location updates from the mobile device 130 of the transit user 170 as the transit user 170 moves within the certain area of the transit system 100. The correlated location is updated based on the movement of the transit user 170. The server 110 provides a notification of identification to the transit user 170 and requests the transit user 170 to provide a transit pass or other means of verification.

At block 612, the transit pass is received by the server 110 from the transit user 170. The transit user 170 may either upload, scan, and/or enter details of the transit pass on the mobile device 130 and provide it to the server 110. Communication with the app on the mobile device 130 may electronically provide the transit pass without any user intervention.

At block 614, the server 110 verifies terms of the transit pass for the trip by comparing it against a set of predefined rules. The terms of the transit pass may be a validity of the transit pass, a balance or an amount for the trip, and/or a privilege associated with the transit pass. The verification ensures that the transit user 170 has paid for the trip and/or is privileged to take the trip. In case the transit user 170 has not yet paid for the trip, the transit user 170 is notified by the server 110 to pay for the trip. The transit user 170 pays for the trip using their app, web portal or station vending machine that communicates that to the backend system 160.

At block 616, based on the verification of the terms of the transit pass, the transit user 170 is authorized by the server 110 to use the transit pass to traverse through the access control point 150. The transit user 170 is notified of the successful verification with a display on the fare gate and/or their phone.

At block 618, the server 110 communicates to the backend system 160 to grant access to the transit user 170 through the access control point 150 when the transit user 170 is within a minimum threshold distance from the access control point 150.

At block 620, the transit user 170 uses the transit pass for traversing through the access control point 150 and using the transit system 100 to take the trip.

At block 622, after the transit user 170 has used the transit pass for the trip, exits the transportation system, and/or the transit pass has expired for the trip, the server 110 stops tracking the user identifiers of the transit user 170. The user identifiers can be deleted until gathered again for the transit user 170 when they reenter the transportation system.

Figure 7:
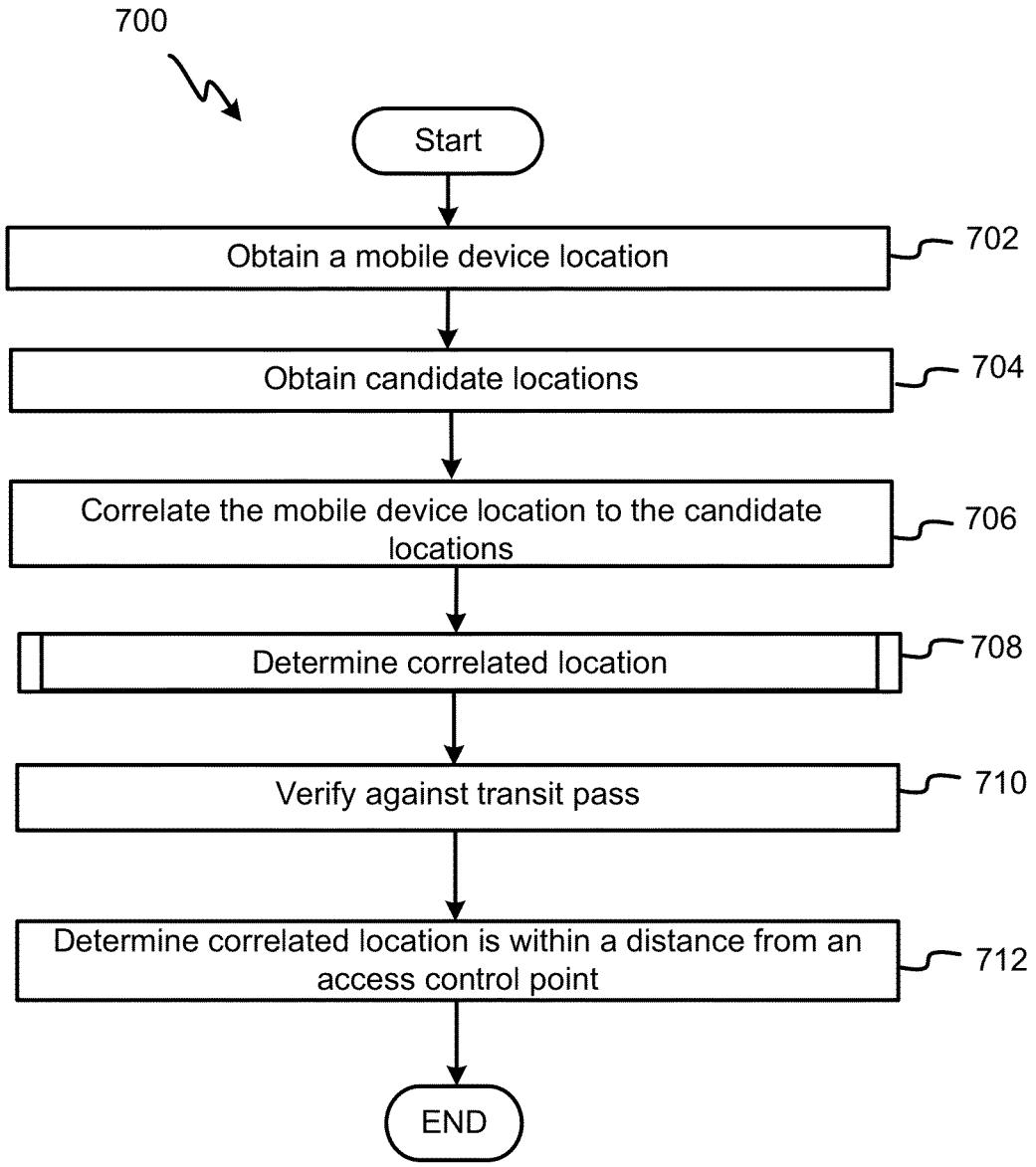
FIG. 7 illustrates a flowchart of an embodiment of a method for operating a access control point within the transit system based on correlation of a mobile device location to a candidate location.

FIG. 7 illustrates a method 700 for correlating the mobile device location 302 to the candidate locations 304 in a transit system 100, according to an embodiment of the present disclosure. The depicted portion of the method 700 starts at block 702 where the mobile device location 302 is received from a mobile device 130 of a transit user 170. The transit user 170 approaches towards the access control points 150 to take a current trip through the transit system 100 by passing through the access control points 150. The access control point 150 may be a fare gate, an entrance/exit, or a passage of the transit system 100 that may or may not have any gate, barriers or paddles that may impede movement. A plurality of transit users 170 are within a certain area of the transit system 100.

The plurality of transit users 170 include a first transit user 170-1 at a candidate location 304-1, a second transit user 170-2 at a candidate location 304-2, and a third transit user 170-3 at a candidate location 304-3. The transit user 170 transmits a mobile device location for identification. The transit user 170 uses the mobile device 130 and the positioning system 120 to determine the mobile device location 302.

At block 704, the candidate locations 304 of the plurality of transit users 170 are identified by the tracking system 140. The candidate locations 304 are received by the server 110 from the tracking system 140 of the transit system 100.

At block 706, the candidate location 304-1 is correlated to the mobile device location 302.

At block 708, based on the correlation of a candidate location 304-1 to the mobile device location 302, a correlated location of the transit user 170 is determined. The correlated location is determined based at least in part on the mobile device location 302 and the candidate location 304-1. Changes in the mobile device location 302 of the transit user 170 are tracked. The correlated location is updated based on changes in the mobile device location 302 of the transit user 170.

At block 710, a transit pass is received from the transit user 170. Terms of the transit pass are verified against predetermined rules to validate payment for the current trip. The transit user 170 may pay for the current trip before or after passing through the access control point 150. The transit user 170 may also use privileges associated with the transit pass to take the current trip.

At block 712, after the transit pass is verified, the correlated location of the transit user 170 is determined to be within a predetermined threshold distance from the access control point 150. When the correlated location of the transit user 170 is within the predetermined threshold distance from the access control point 150, the access control point 150 is opened for the transit user 170. The opening and closing of the access control points 150 are controlled by sensors, motors and actuators operated by fare gate and authorized by the backend system 160. The sensors may be mounted on or near the access control points 150 for operation. The access control point 150 is opened using the backend system 160. After expiration of the transit pass for the current trip and/or usage of the transit pass for the current trip by the transit user 170, the mobile device location 302 of the transit user 170 is no longer tracked by the server 110.

FIGS. 8A-8D illustrate various methods of correlating the mobile device location 302 of the transit user 170 to the candidate locations 304 of the plurality of transit users 170, according to an embodiment of the present disclosure.

Figure 8A:
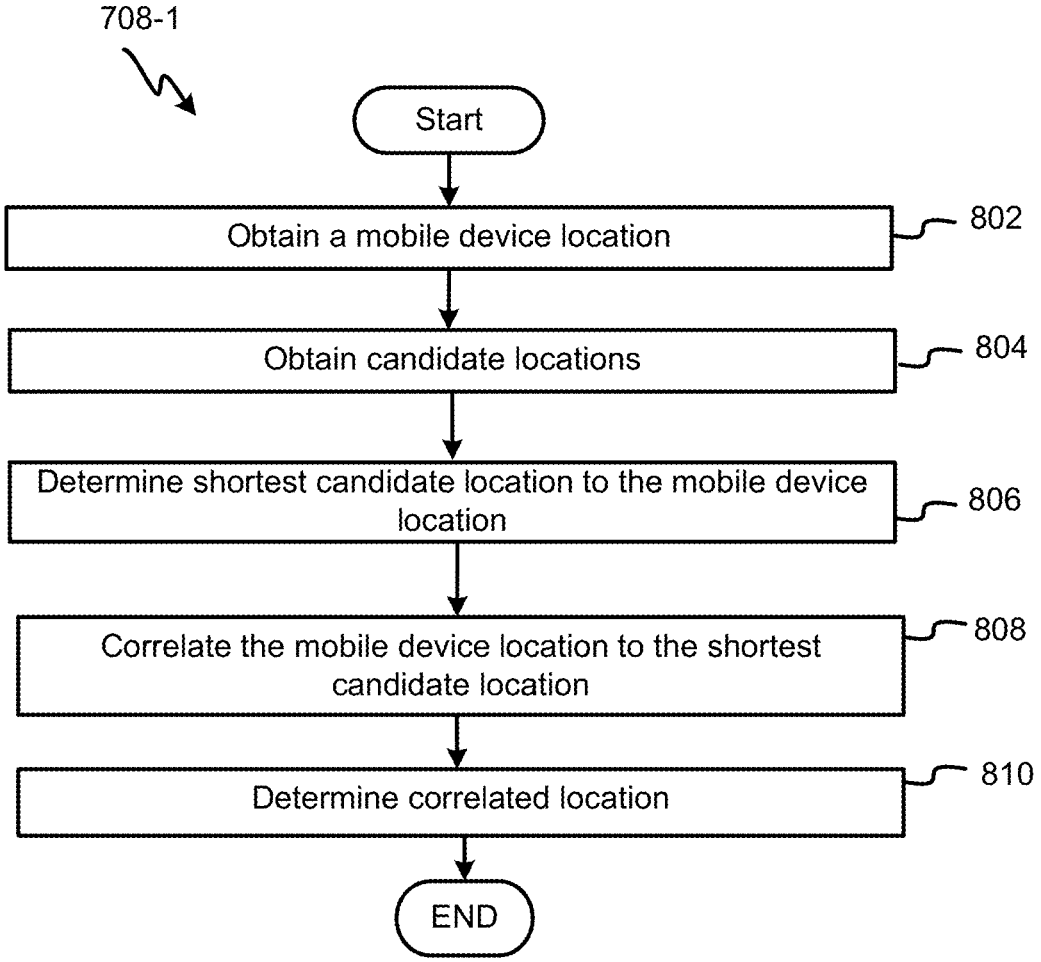
FIGS. 8A-8D illustrate flowcharts of different embodiments of correlating the mobile device location to the candidate location.

FIG. 8A illustrates a method 708-1 for correlating the mobile device location 302 to a candidate location having a shortest distance to the mobile device location 302, according to an embodiment of the present disclosure. The depicted portion of the method 708-1 starts at block 802, where the mobile device location 302 is received from the mobile device 130 of the transit user 170. The plurality of transit users 170 are within the transit area 202 of the transit system 100. The plurality of transit users 170 are approaching towards the access control point 150 in order to access the transit system 100 for a current trip. The plurality of transit users 170 include a first transit user 170-1 at a candidate location 304-1, a second transit user 170-2 at a candidate location 304-2, and a third transit user 170-3 at a candidate location 304-3. The transit user 170 transmits its mobile device location for identification. The transit user 170 transmits the mobile device location 302 for identification. The transit user 170 uses the mobile device 130 and the positioning system 120 to determine the mobile device location 302.

At block 804, the candidate locations 304 of the plurality of transit users 170 are acquired by the server 110 from the tracking system 140.

At block 806, distances of each of the candidate locations 304 to the mobile device location 302 are determined by the server 110. Based on the distances, a shortest distance of the candidate locations 304 to the mobile device location 302 is determined. A first candidate location 304-1 is determined to be the shortest distance to the mobile device location 302

At block 808, the first candidate location 304-1 having the shortest distance to the mobile device location 302 is correlated to the mobile device location 302.

At block 810, a correlated location of the transit user 170 is determined by the server 110 based at least in part on the mobile device location 302 and the candidate location 304-1. Embodiments can go through this algorithm iteratively as the transit user 170 moves while being observed by the tracking system 140 to improve correlation over time.

Figure 8B:
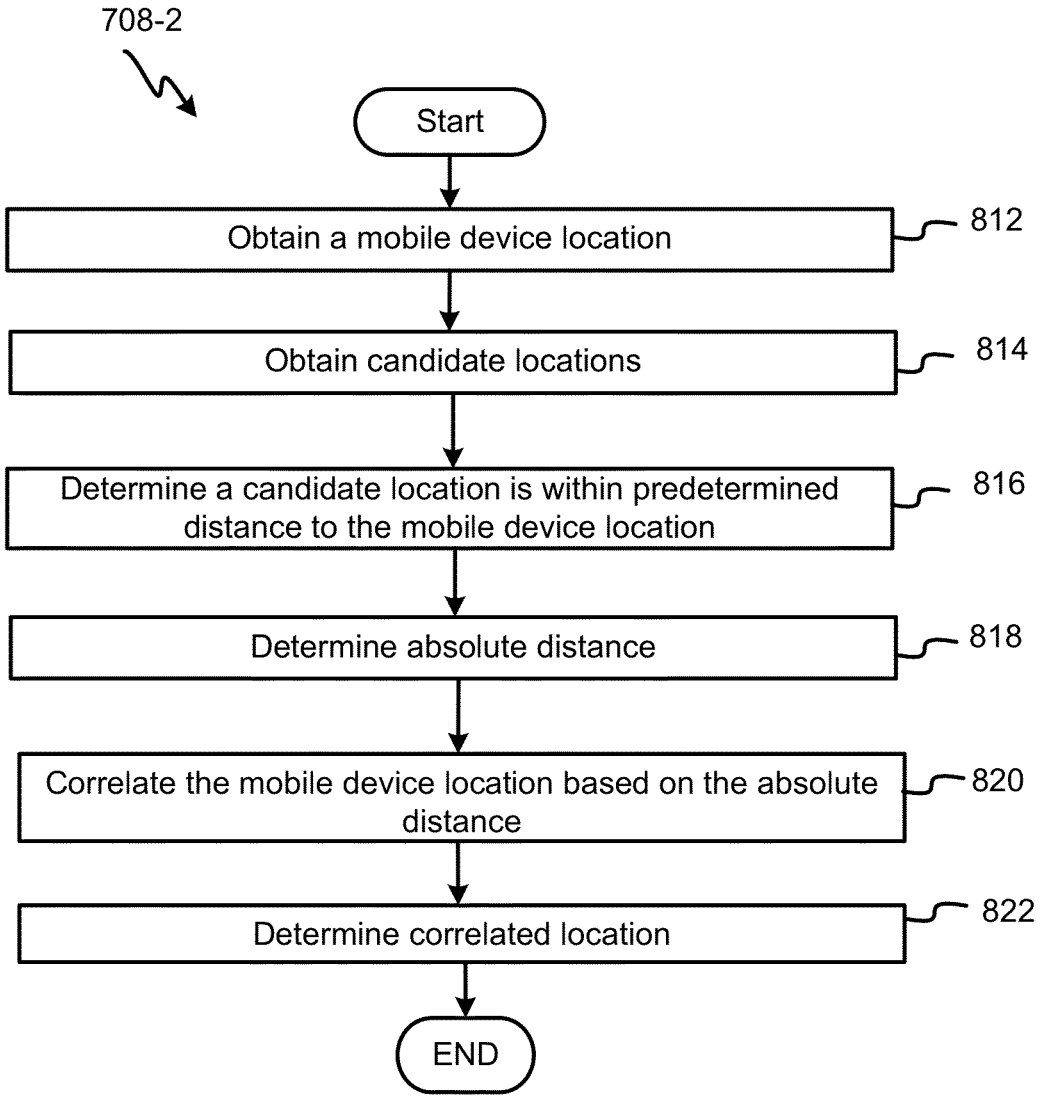

FIG. 8B illustrates a method 708-2 for correlating the mobile device location 302 to an absolute distance of candidate location 304 and the mobile device location 302, according to an alternative embodiment of the present disclosure. The depicted portion of the method 708-2 starts at block 812, where the mobile device location 302 is received from the mobile device 130 of the transit user 170. The plurality of transit users 170 include the first transit user 170-1 at the candidate location 304-1, the second transit user 170-2 at the candidate location 304-2, and the third transit user 170-3 at the candidate location 304-3. The plurality of transit users 170 are within the transit area 202 of the transit system 100. The transit user 170 transmits the mobile device location 302 for identification. The transit user 170 uses the mobile device 130 and the positioning system 120 to determine the mobile device location 302.

At block 814, the candidate locations 304 of the plurality of transit users 170 are acquired by the server 110 from the tracking system 140.

At block 816, distances of each of the candidate locations 304 are compared to the mobile device location 302 by the server 110. The candidate location 304-1 is determined for correlation with the mobile device location 302. The candidate location 304-1 is determined to be within a threshold distance from the transit user 170.

At block 818, an absolute distance is determined when the candidate location 304-1 is within the threshold distance from the mobile device location 302. The absolute distance is used to correlate with the mobile device location 302.

At block 820, the candidate location 304 is correlated to the mobile device location 302 based on the absolute distance.

At block 822, a correlated location of the transit user is determined based at least in part on the mobile device location 302, the candidate location 304-1, and the absolute distance.

Figure 8C:
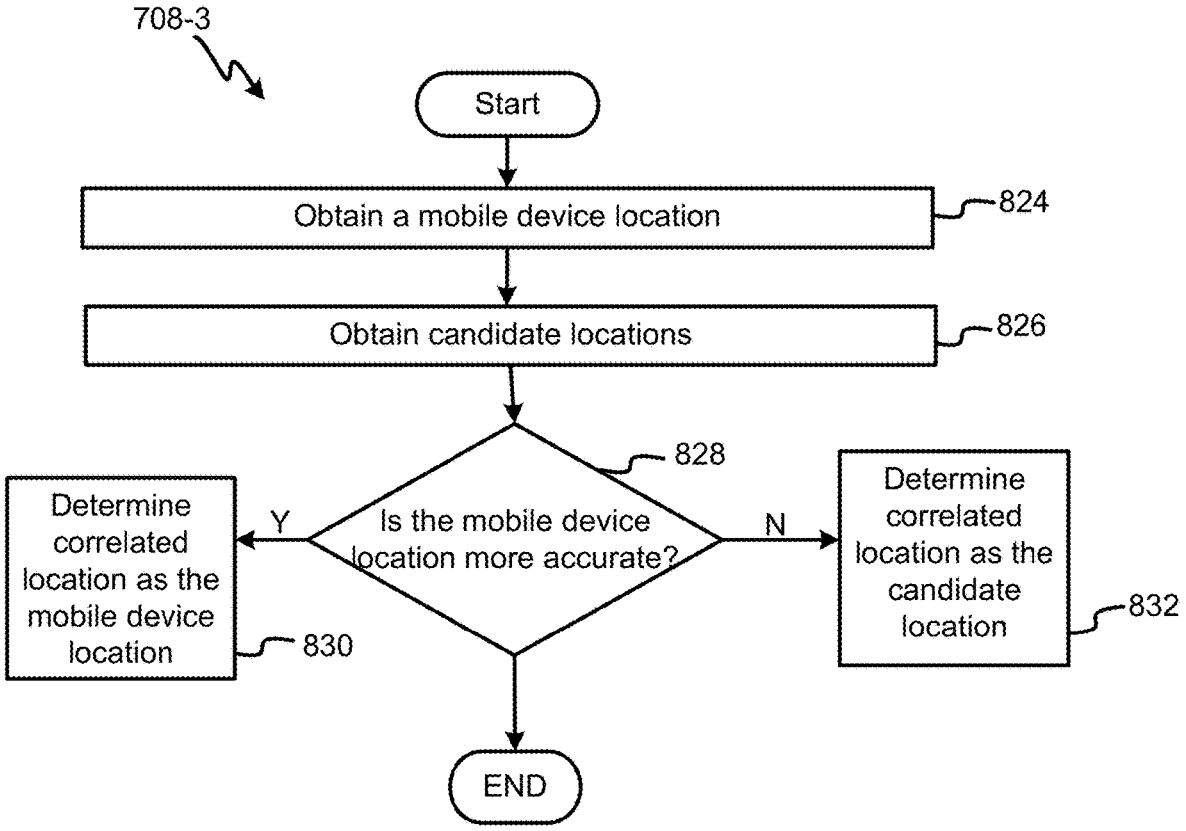

FIG. 8C illustrates a method 708-3 for correlating the mobile device location 302 to an accurate candidate location 304, according to another embodiment of the present disclosure. The depicted portion of the method 708-3 starts at block 824, where the mobile device location 302 is received from the mobile device 130 of the transit user 170. The plurality of transit users 170 including the first transit user 170-1 at the candidate location 304-1, the second transit user 170-2 at the candidate location 304-2, and the third transit user 170-3 at the candidate location 304-3 are within the certain area of the transit system 100. The transit user 170 transmits the mobile device location 302 for identification. The transit user 170 uses the mobile device 130 and the positioning system 120 to determine the mobile device location 302.

At block 826, the candidate locations 304 of the plurality of transit users 170 are acquired by the server 110 from the tracking system 140. The candidate location 304 having a shortest distance to the mobile device location 302 is determined as the candidate location 304 for correlation. The candidate location 304-1 is the candidate location 304 with the shortest distance to the mobile device location 302.

At block 828, the server 110 performs a check to determine whether the mobile device location 302 or the candidate location 304-1 is more accurate. The server 110 correlates the mobile device location 302 to the candidate location 304-1. The server 110 further determines a correlated location or herein referred as 'an actual location' of the transit user 170 and compares the mobile device location 302 and the candidate location 304-1 to the actual location. The mobile device location 302 or the candidate location 304-1 closest (with minimum deviation) to the actual location is determined as more accurate.

At block 830, the candidate location 304-1 is determined closest to the actual location and therefore, is more accurate than the mobile device location 302. The correlated location is determined as the candidate location 304-1.

At block 832, the mobile device location 302 is determined closest to the actual location and therefore, is more accurate than the candidate location 304-1. The correlated location is determined as the mobile device location 302.

Figure 8D:
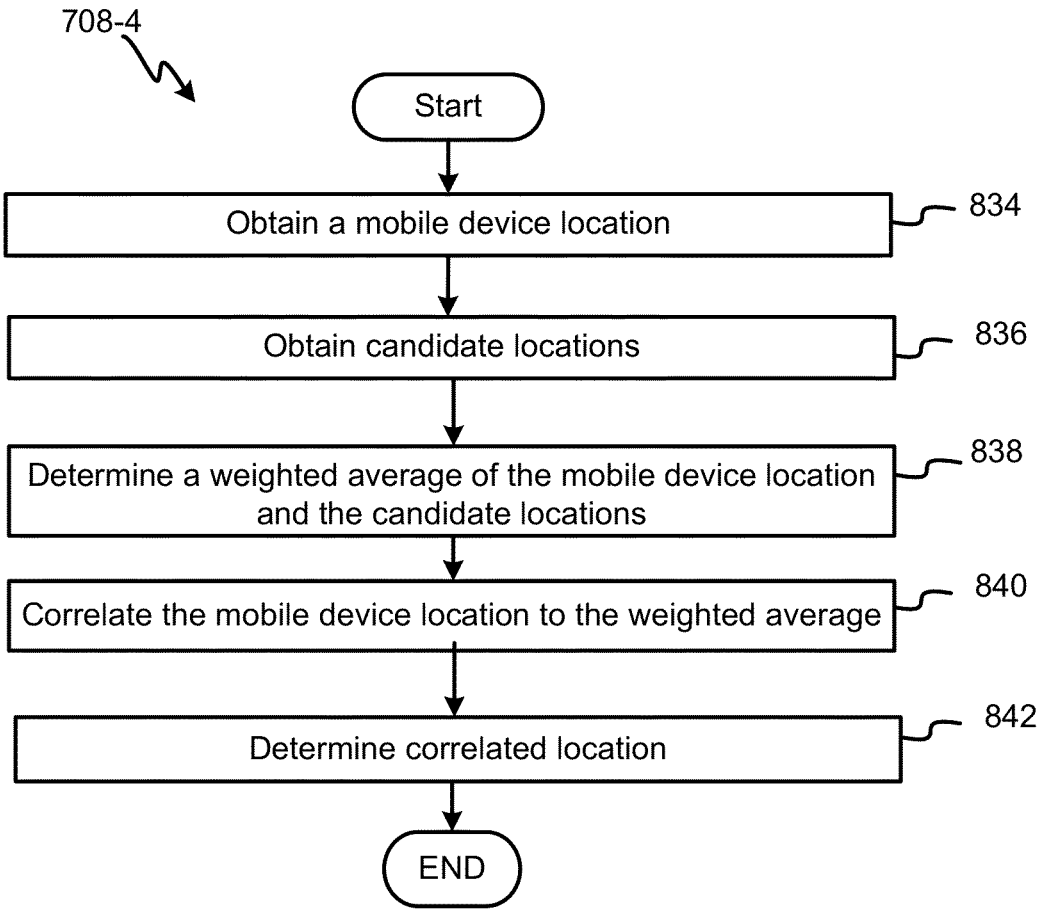

FIG. 8D illustrates a method 708-4 for correlating the mobile device location 302 to a weighted average of the mobile device location 302 and the candidate location 304, according to an embodiment of the present disclosure. The depicted portion of the method 708-4 starts at block 834, where the mobile device location 302 is received from the mobile device 130 of the transit user 170. The plurality of transit users 170 are within the certain area of the transit system 100. The transit user 170 transmits the mobile device location 302 for identification. The transit user 170 uses the mobile device 130 and the positioning system 120 to determine the mobile device location 302.

At block 836, the candidate locations 304 of the plurality of transit users 170 are acquired by the server 110 from the tracking system 140. A candidate location having a shortest distance to the mobile device location 302 is determined. The candidate location 304-1 is determined to have the shortest distance to the mobile device location 302.

At block 838, a weighted average of the mobile device location 302 and the candidate location 304-1 is determined by the server 110. The weighted average over time should minimize as the correlation resolves.

At block 840, the mobile device location 302 is correlated to the weighted average.

At block 842, the weighted average is correlated to the mobile device location 302 by the server 110 to determine a correlated location. The correlated location of the transit user 170 is determined based at least in part on the mobile device location 302 and the weighted average location.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail.

Implementation of the techniques, blocks, steps and means described above may be done in various ways. For example, these techniques, blocks, steps and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described above, and/or a combination thereof.

Also, it is noted that the embodiments may be described as a process which is depicted as a flowchart, a flow diagram, a swim diagram, a data flow diagram, a structure diagram, or a block diagram. Although a depiction may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Furthermore, embodiments may be implemented by hardware, software, scripting languages, firmware, middleware, microcode, hardware description languages, and/or any combination thereof. When implemented in software, firmware, middleware, scripting language, and/or microcode, the program code or code segments to perform the necessary tasks may be stored in a machine readable medium such as a storage medium. A code segment or machine-executable instruction may represent a procedure, a function, a subprogram, a program, a routine, a subroutine, a module, a software package, a script, a class, or any combination of instructions, data structures, and/or program statements. A code segment may be coupled to another code segment or a hardware circuit by passing and/or receiving information, data, arguments, parameters, and/or memory contents. Information, arguments, parameters, data, etc. may be passed, forwarded, or transmitted via any suitable means including memory sharing, message passing, token passing, network transmission, etc.

For a firmware and/or software implementation, the methodologies may be implemented with modules (e.g., procedures, functions, and so on) that perform the functions described herein. Any machine-readable medium tangibly embodying instructions may be used in implementing the methodologies described herein. For example, software codes may be stored in a memory. Memory may be implemented within the processor or external to the processor. As used herein the term "memory" refers to any type of long term, short term, volatile, nonvolatile, or other storage medium and is not to be limited to any particular type of memory or number of memories, or type of media upon which memory is stored.

Moreover, as disclosed herein, the term "storage medium" may represent one or more memories for storing data, including read only memory (ROM), random access memory (RAM), magnetic RAM, core memory, magnetic disk storage mediums, optical storage mediums, flash memory devices and/or other machine readable mediums for storing information. The term "machine-readable medium" includes, but is not limited to portable or fixed storage devices, optical storage devices, and/or various other storage mediums capable of storing that contain or carry instruction(s) and/or data.

While the principles of the disclosure have been described above in connection with specific apparatuses and methods, it is to be clearly understood that this description is made only by way of example and not as limitation on the scope of the disclosure.

What is claimed is:

1. A transit system for a transportation system, the transit system comprising:

an access control point configured to provide an access through the transit system;

a positioning system includes one or more radiofrequency (RF) transceivers or transmitters configured to identify a first location of a transit user based on radio frequency (RF) information received from a mobile device;

a tracking system including one or more cameras configured to capture:

a plurality of candidate locations and a plurality of candidate identifiers for one or more transit users, and candidate identifiers of the transit user;

a server configured to track the transit user within the transit system, wherein the transit user is tracked by the server configured to:

obtain the first location and the candidate identifiers of the transit user, wherein the first location is located within a certain area of the transit system;

obtain the plurality of candidate locations and the plurality of candidate identifiers for the one or more transit users from the tracking system, wherein the plurality of candidate locations are locations of the one or more transit users located within the certain area of the transit system and the plurality of candidate identifiers are one or more visual cues of the one or more transit users, and the candidate identifiers of the transit user are visual cues of the transit user;

correlate the first location of the transit user to a candidate location of the plurality of candidate locations;

determine a correlated location of the transit user based at least in part on the first location and the candidate location, wherein the correlation is a match of the first location with the candidate location to determine the correlated location;

compare the candidate identifiers of the transit user with the plurality of candidate identifiers of the one or more transit users;

verify both:

the first location of the transit user based on matching the first location with the correlated location, and the candidate identifiers of the transit user based on the comparison of the candidate identifiers with the plurality of candidate identifiers of the one or more transit users; and update the correlated location based on a change in the first location of the transit user;

receive a transit pass from the transit user;

verify terms of the transit pass for a current trip through the transit system using the access control point; and authorize the transit user based on the verification of the terms of the transit pass to allow usage of the transit pass for the current trip through the transit system until the usage expires for the current trip, wherein the authorization causes the access control point to open and transit pass information to be updated.

2. The transit system for the transportation system of claim 1, wherein the access control point comprises a transit fare gate.

3. The transit system for the transportation system of claim 1, wherein the candidate location is a closest candidate location, among the plurality of candidate locations, to the first location.

4. The transit system for the transportation system of claim 1, wherein the candidate location is within a threshold distance from the first location, and the server is further configured to determine the correlated location of the transit user based on an absolute distance when the candidate location is within the threshold distance from the first location.

5. The transit system for the transportation system of claim 1, wherein the server is further configured to:

permit the transit user, a passage through the access control point;

move and/or unlock a physical barrier at the access control point; and provide an indication to the transit user to pass through the access control point.

6. The transit system for the transportation system of claim 1, wherein the server is further configured to determine the correlated location of the transit user based on a weighted average of the first location and the candidate location.

7. The transit system for the transportation system of claim 1, wherein the server is further configured to:

determine the correlated location of the transit user based on whether the first location is less accurate than a corresponding candidate location, and based on a determination that:

the first location is less accurate than the corresponding candidate location, the correlated location is identified as the candidate location, or the first location is more accurate than the corresponding candidate location, the correlated location is identified as the first location, wherein the determination is based on a comparison of the first location and the corresponding candidate location with an actual location of the transit user.

8. The transit system for the transportation system of claim 1, wherein the server is further configured to receive location updates from the mobile device based on changes in velocity of the transit user.

9. The transit system for the transportation system of claim 5, wherein the physical barrier at the access control point is moved and/or unlocked when the correlated location of the transit user is within a threshold distance from the access control point.

10. The transit system for the transportation system of claim 1, the server is further configured to suspend tracking of the transit user based on expiry of the transit pass for the current trip, and/or the usage of the transit pass for the current trip.

11. The transit system for the transportation system of claim 1, wherein tracking of the transit user within the transit system includes the server further configured to:

obtain a temporary identifier from the transit user based on applicable laws and regulations, user preferences and/or user authorization, the temporary identifier is at least one of a name, an address, a credit card number, an account number, a ticket number, a username, or a phone number of the transit user, and the temporary identifier is encrypted to ensure security and/or privacy of the transit user.

12. The transit system for the transportation system of claim 1, wherein the one or more visual cues of the one or more transit users and the transit user are at least one of personal-identifying features such as facial features, gestures, velocity, body movements, attire of the one or more transit users, wherein obtaining the one or more visual cues is based on applicable laws and regulations, user preferences and/or user authorization.

13. The transit system for the transportation system of claim 12, wherein obtaining the one or more visual cues of the one or more transit users and the visual cues of the transit user exclude obtaining the facial features of the one or more transit users.

14. The transit system for the transportation system of claim 1, wherein verifying the terms of the transit pass includes at least one of verifying: payment for the current trip, special privileges for the transit user, credit amount in the transit pass, biometric features of the transit user and/or a voucher associated with the transit pass.

15. A method of operating an access control point within a transit system, the method comprising:

tracking a transit user within the transit system by:

obtaining a first location and candidate identifiers of the transit user using one or more cameras, wherein:

the first location is located within a certain area of the transit system, and the first location is based on radio frequency (RF) information received from a mobile device including one or more radiofrequency (RF) transceivers or transmitters;

obtaining a plurality of candidate locations and a plurality of candidate identifiers for one or more transit users from a tracking system, wherein the plurality of candidate locations are locations of the one or more transit users located within the certain area of the transit system and the plurality of candidate identifiers are one or more visual cues of the one or more transit users, and the candidate identifiers of the transit user are visual cues of the transit user;

correlating the first location of the transit user to a candidate location of the plurality of candidate locations;

determining a correlated location of the transit user based at least in part on the first location and the candidate location, wherein the correlating is a match of the first location with the candidate location to determine the correlated location;

comparing the candidate identifiers of the transit user with the plurality of candidate identifiers of the one or more transit users;

verifying both:

the first location of the transit user based on matching the first location with the correlated location, and the candidate identifiers of the transit user based on the comparison of the candidate identifiers with the plurality of candidate identifiers of the one or more transit users; and updating the correlated location based on a change in the first location of the transit user;

receiving a transit pass from the transit user;

verifying terms of the transit pass, for a current trip through the transit system using the access control point; and authorizing the transit user based on the verification of the terms of the transit pass to allow usage of the transit pass for the current trip through the transit system until the usage expires for the current trip, wherein the authorizing causes the access control point to open and transit pass information to be updated.

16. The method of claim 15, further comprising suspending the tracking of the transit user based on expiry of the transit pass for the current trip, and/or the usage of the transit pass for the current trip.

17. The method of claim 15, further comprising:

permitting the transit user, a passage through the access control point;

moving and/or unlocking a physical barrier at the access control point; and providing an indication to the transit user to pass through the access control point.

18. A non-transitory computer-readable medium having instructions stored thereon, wherein the instructions, when executed by one or more processors of a transit system, cause the transit system to:

track a transit user within the transit system by the one or more processors configured to:

obtain a first location and candidate identifiers of the transit user using one or more cameras, wherein:

the first location is located within a certain area of the transit system, and the first location is based on radio frequency (RF) information received from a mobile device including one or more radiofrequency (RF) transceivers or transmitters;

obtain a plurality of candidate locations and a plurality of candidate identifiers for one or more transit users from a tracking system, wherein the plurality of candidate locations are locations of the one or more transit users located within the certain area of the transit system and the plurality of candidate identifiers are one or more visual cues of the one or more transit users, and the candidate identifiers of the transit user are visual cues of the transit user;

correlate the first location of the transit user to a candidate location of the plurality of candidate locations;

determine a correlated location of the transit user based at least in part on the first location and the candidate location, wherein the correlation is a match of the first location with the candidate location to determine the correlated location;

compare the candidate identifiers of the transit user with the plurality of candidate identifiers of the one or more transit users;

verify both:

the first location of the transit user based on matching the first location with the correlated location, and the candidate identifiers of the transit user based on the comparison of the candidate identifiers with the plurality of candidate identifiers of the one or more transit users; and update the correlated location based on a change in the first location of the transit user;

receive a transit pass from the transit user;

verify terms of the transit pass, for a current trip through the transit system using an access control point of the transit system; and authorize the transit user based on the verification of the terms of the transit pass to allow usage of the transit pass for the current trip through the transit system until the usage expires for the current trip, wherein the authorization causes the access control point to open and transit pass information to be updated.

19. The non-transitory computer-readable medium of claim 18, wherein the correlated location of the transit user is determined based on a weighted average of the first location and the candidate location.

20. The non-transitory computer-readable medium of claim 18, wherein the correlated location of the transit user is determined based on an absolute distance when the candidate location is within a threshold distance from the first location.

* * * * *